US006477866B1

(12) United States Patent
Chamberlin et al.

(10) Patent No.: US 6,477,866 B1
(45) Date of Patent: Nov. 12, 2002

(54) WASHING MACHINE MOTOR CUT-OFF

(75) Inventors: Edward R. Chamberlin, Loveland, OH (US); Robert G. Whitman, Cincinnati, OH (US)

(73) Assignee: Standex International Corporation, Salem, NH (US)

( * ) Notice: Subject to any disclaimer, the term of this patent is extended or adjusted under 35 U.S.C. 154(b) by 89 days.

(21) Appl. No.: 09/834,530

(22) Filed: Apr. 13, 2001

(51) Int. Cl.[7] ..... D06F 33/02
(52) U.S. Cl. ..... 68/12.02; 68/12.01
(58) Field of Search ..... 68/12.01, 12.02, 68/12.14, 12.16, 12.24, 23 R, 23.3

(56) References Cited

U.S. PATENT DOCUMENTS 1,756,081 A * 4/1930 Ballard
1,908,382 A * 5/1933 Vanderveld
2,865,184 A * 12/1958 Shortland
3,403,538 A * 10/1968 Andrew et al.
4,217,532 A * 8/1980 Alfieri et al.
5,535,622 A * 7/1996 Walter
5,561,990 A 10/1996 Berkcan et al.
5,561,991 A 10/1996 Berkcan et al.
5,669,095 A 9/1997 Dausch et al.
5,823,017 A 10/1998 Hapke et al.
6,151,742 A 11/2000 Dausch et al.

FOREIGN PATENT DOCUMENTS

JP 3-7200 * 1/1991
JP 5-269292 * 10/1993
JP 2001-276467 * 10/2001

* cited by examiner

*Primary Examiner*—Frankie L. Stinson
(74) *Attorney, Agent, or Firm*—Wood Herron & Evans LLP

(57) ABSTRACT

A washing machine (10) includes a motor cut-off circuit (70) which includes a fuse (100) and a blow switch (110) responsive to a brake failure signal (BFS) to blow the fuse (100) and prevent the motor (40) from thereafter being energized until the fuse (100) is reset or replaced.

13 Claims, 3 Drawing Sheets

WASHING MACHINE MOTOR CUT-OFF

BACKGROUND OF THE INVENTION

I. Field of the Invention

The present invention relates to washing machines and more particularly to a motor cut-off for washing machines.

II. Description of Prior Art

Washing machines are commonplace in most homes. A typical washing machine includes a drive system having a motor operatively coupled to a drive shaft. The drive shaft includes a first or input shaft which rotates in response to the motor such as via a pulley and brake mechanism. The input shaft is coupled to a transmission having a second or output shaft of the drive shaft, and which in turn supports a clothes basket within a water tub, and an agitator for selective rotation with the clothes basket. In one mode of operation, such as during wash and rinse cycles, the output shaft is caused to rotate back and forth so as to rotate the basket and/or agitator back and forth to thus agitate the clothes and water in the basket for cleaning or rinsing of the clothing. In another mode, such as during the spin cycle, the output shaft spins quickly so as to spin the clothes basket and remove water from the clothing by centrifugal force.

The controls of the washing machine typically include a timer or other components or circuitry which output signals to selectively energize and deenergize the motor, and control other functions of the washing machine, as necessary for washing clothes. The signal to the motor may be coupled from the controls to a motor drive circuit. The motor drive circuit, in turn, is coupled between the power and ground rails of the machine so as to power the motor. When the basket is spinning, such as during the spin cycle of the machine, it is desired to prevent users from sticking a hand into the area of the basket. To that end, the washing machine normally includes a lid that must be in the closed position for the basket to spin. A lid switch may be mounted to the machine near the lid to detect if the lid is opened during the spin cycle (as well as possibly during other cycles, if desired). The lid switch may include a magnet mounted to the lid, and a reed switch mounted to the machine housing adjacent the lid. The reed switch would typically be in series with the motor drive circuit, or a portion thereof, such that when the reed switch indicates that the lid is open (e.g., the magnet is spaced away from the reed switch), no power can flow to the motor, and the clothes basket will slow down and stop spinning. Additionally, when the motor is deenergized, the brake associated with the drive shaft is supposed to react quickly to slow down and stop rotation of the shaft and thus the basket whenever opening of the lid is detected.

Should the brake fail, however, the basket will continue to spin until it slows down due to frictional and other forces inherent in the machine. Unfortunately, if the brake fails, further use of the machine may expose the user to harm because each time the basket spins, opening of the lid will no longer result in a prompt cessation of the spinning motion. To avoid that problem, the controls may be shut down or otherwise rendered inoperable so that they cannot provide a signal to the motor drive circuit until after a service technician has inspected and repaired the machine. As is known in the art, if, for example, the controls of the washing machine indicate that the spin cycle is over, but the speed of rotation continues to be too fast (such as indicated by a speed sensor associated with the drive shaft or clothes basket), a brake failure signal may be generated. The brake failure signal indicates that the brake has failed, or at least is no longer operating within acceptable parameters, and is used by the controls to shut down. Design of controls to cause them to shut down can be costly and complex, or may not be applicable to all washing machines.

SUMMARY OF THE INVENTION

The present invention provides a motor cut-off by which to permanently or temporarily prevent the motor from being energized after a brake failure, but which does not necessarily require that the controls be shut down or otherwise rendered inoperative. To this end, and in accordance with the principles of the present invention, included in series between the motor drive, or a portion thereof, and the power and ground rails is a fuse and a blow switch coupled to the fuse and one of the power or ground rails as appropriate by which to blow the fuse in response to the brake failure signal. Where a lid switch is used, the lid switch may also be in series therewith. When the fuse is blown, either permanently or temporarily (such as in the case of a resettable breaker), current cannot flow through the motor drive circuit, or portion thereof (irrespective of the state of the lid switch), thereby preventing the motor from being energizable until the fuse is either reset or replaced such as would be done in a service call.

By virtue of the foregoing, there is thus provided an improved brake failure safety system which eliminates the need for the controls in a washing machine to be shut down or rendered inoperative in the event of a brake failure. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and, together with the general description of the invention given above and the detailed description of the embodiment given below, serve to explain the principles of the present invention.

DETAILED DESCRIPTION OF THE DRAWINGS

Figure 1:
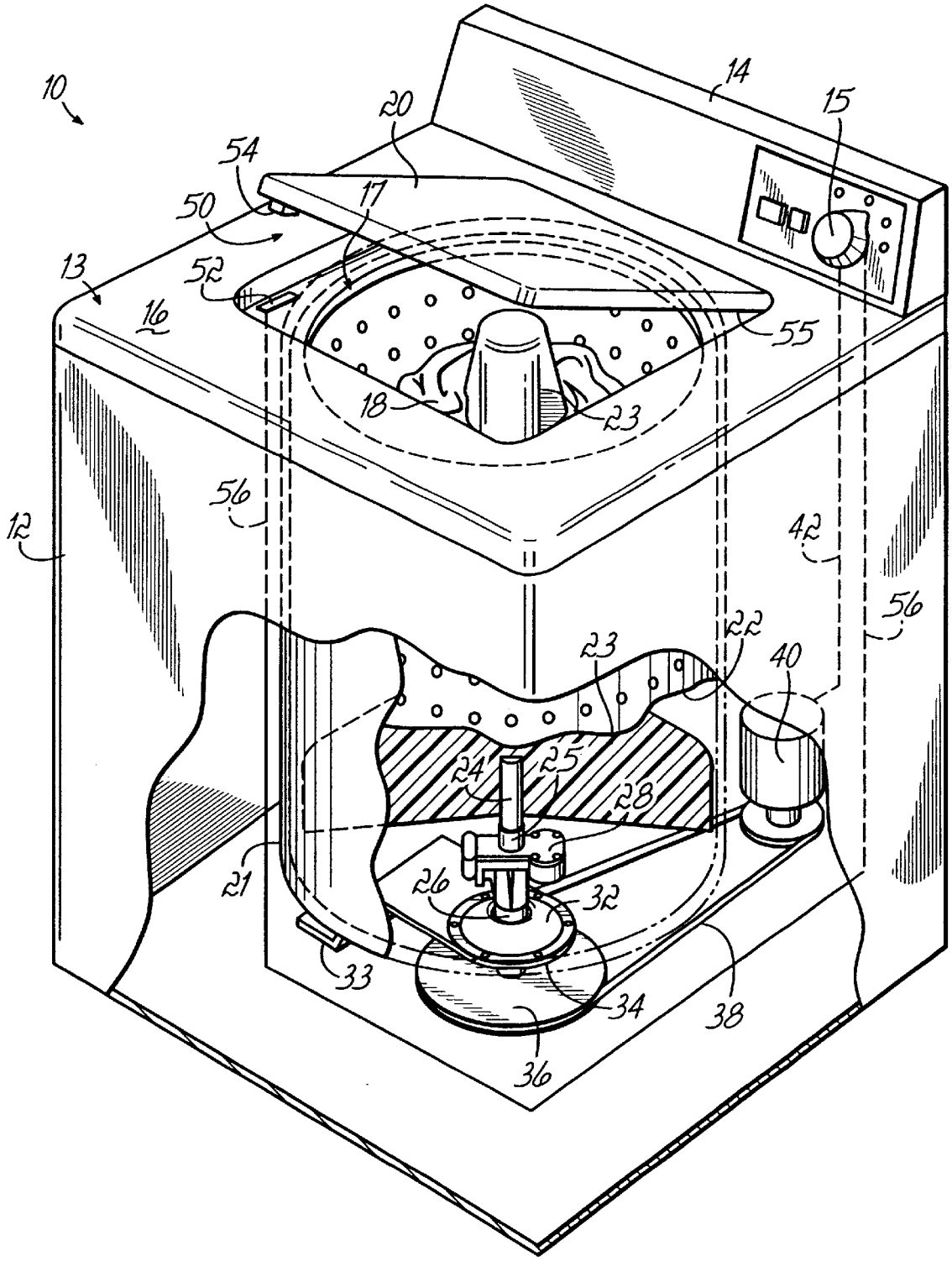
FIG. 1 is a perspective, partially cut-away view of a washing machine for purposes of explaining the principles of the present invention.

With reference to FIG. 1 there is shown an exemplary, conventional washing machine 10 for purposes of explaining the principles of the present invention. Washing machine 10 includes a shell or housing 12, which may be comprised of several adjoined pieces. At the top 13 of machine 10 is a control panel 14 housing therein the controls 15 of machine 10. Controls 15 may be electronic, programmable, electromechanical or a combination thereof as is conventional. Also across the top 13 of machine 10 is a user-accessible surface 16 with an opening 17 through which clothes 18 are to be loaded into or removed from machine 10. A lid 20 is hingedly mounted at top 13 and which, as is conventional, may be open (as shown) for loading and removal of clothing, or closed (not shown).

Washing machine 10 also includes a water tub 21 containing a rotatably mounted clothes basket 22 which holds the clothing 18. Basket 22 includes a central agitator 23, and is mounted for rotation on the output shaft 24 of a drive shaft 25 that extends within housing 12 and below basket 22. Drive shaft 25 includes an input shaft 26. Mounted for rotation with drive shaft 25 and coupling input shaft 26 and output shaft 24 is a transmission 28 as is conventional to facilitate back and forth rotation for agitation during wash and rinse cycles, and for spinning speeds during the spin cycle all as indicated by controls 15, so as to provide proper mechanical rotational operation of shaft 25 and basket 22.

Shaft 25, and particularly input shaft 26 thereof, is held to housing 12 by a fixed mounting plate 32 secured to a support 33 in housing 12. Shaft 26 extends rotatably through mounting plate 32 to the brake mechanism 34 which in turn is coupled to pulley 36 to rotate input shaft 26. Pulley 36 is coupled, such as by a drive belt 38, to motor 40 which is selectively energized over cable 42 by controls 15.

Washing machine 10 may also include a lid switch system 50 including a reed switch 52 mounted at top 13 along surface 16 and magnet 54 affixed to the underside 55 of lid 20 so as to overlie reed switch 52 when lid 20 is closed. Reed switch 52 is coupled to controls 15 and/or motor 40 via cable 56 to provide an indication that lid 20 is open or closed.

Figure 2:
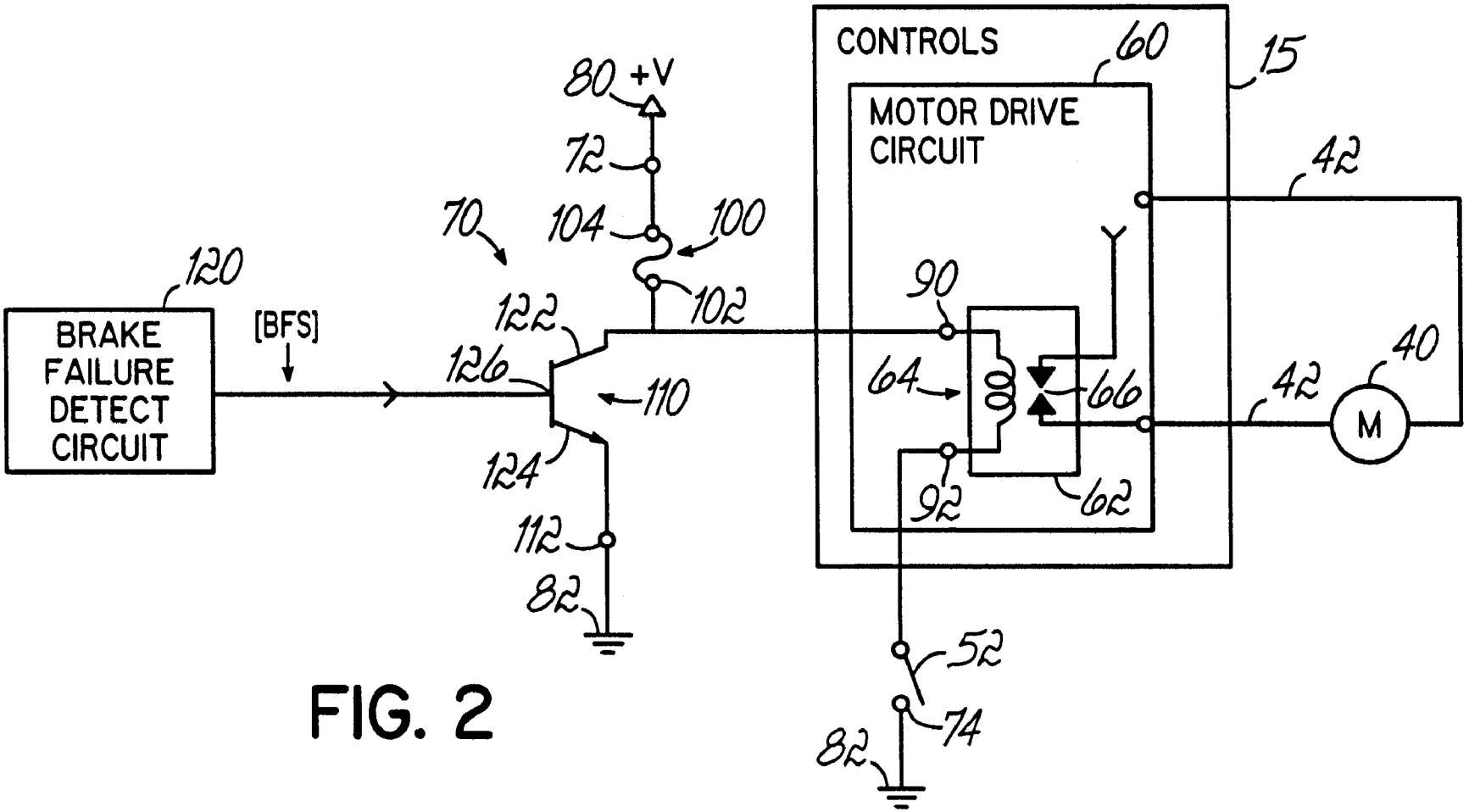
FIG. 2 is a schematic of a motor cut-off of the present invention and which may be used with the washing machine of FIG. 1.

With reference to FIG. 2, motor 40 responds to signals over cable 42 as directed by a motor drive circuit 60 (which may, in part, be included in controls 15). Drive circuit 60 may include a relay 62 having a relay coil 64 and relay contacts 66. Contacts 66, when closed, complete the circuit path between controls 15 and motor 40. Contacts 66 open when power to relay coil 64 is removed. Power to relay coil 64 may be removed or cut-off in accordance with the principles of the present invention by motor cut-off circuit 70 which is in series between relay coil 64 and one or the other of the supply nodes 72, 74 such as node 72 coupled to the positive power supply rail 80 and node 74 coupled to the ground rail 82.

Relay coil 64 includes a first supply terminal 90 and a second supply terminal 92. The second supply terminal 92 of relay coil 64 may be coupled in series with reed switch 52 to ground node 74 as shown in FIG. 2. Alternatively, supply terminal 92 may be directly coupled to ground node 74 if reed switch 52 is not to be part of the series circuit. The first supply terminal 90 of relay coil 64 may be coupled in series with a fuse 100 of circuit 70 to the other power supply node 72. To facilitate the connection, fuse 100 may include a first fuse terminal 102 and a second fuse terminal 104. Fuse terminal 102 may be coupled to the coil first supply terminal 90, and the fuse second terminal 104 may be coupled to the power supply rail 80 via node 72. Thus, fuse 100 and relay coil 64 define a series circuit to allow energization of motor 40 in the conducting state of fuse 100.

To provide the motor cut-off function, circuit 70 includes a blow switch 110. Switch 110 is a normally open or non-conducting switch in series between fuse terminal 102 and another supply node 112 which, in turn, is coupled to ground rail 82 or some other voltage level or current source or sink sufficient to blow fuse 100 when switch 110 is closed. Switch 110 is responsive to a brake failure signal BFS to close switch 110 and thereby cause fuse 100 to blow. Thus, fuse 100, which is normally in a conducting state, will go into a non-conducting state. If fuse 100 is a breaker, the fuse 100 may be reset by a service technician, for example, into the conducting state. If fuse 100 is a single-use fuse, once the non-conducting state is achieved, fuse 100 must be replaced with a new fuse. In the non-conducting state of fuse 100, no current can flow through relay coil 64 thus deenergizing motor 40 until fuse 100 is reset or replaced during a service call, for example. Switch 110 and fuse 100 define a series circuit between the power supply nodes 72 and 112 such that with switch 110 in its normally open state, fuse 100 will conduct current through relay coil 64 to thus allow motor 40 to be energized by circuit 60 for normal operation. Should the brake fail, for example, brake failure detect circuit 120 will generate a signal BFS to cause switch 110 to close placing fuse 100 in series with now-conducting switch 110 between power and ground (80 and 82) thereby overloading fuse 100 and causing it to blow. With fuse 100 blown, it is in the non-conducting state and motor 40 cannot be energized. Until reset or replaced, fuse 100 remains in the non-conducting state notwithstanding return of switch 110 to its open state, such as after signal BFS terminates. Blow switch 110 may be an electronic switch such as an NPN transistor, the collector 122 of which is coupled to fuse 100 (such as at fuse terminal 102), the emitter 124 of which is coupled to node 112 (and, hence, ground rail 82), and the base 126 of which is coupled to receive the brake failure signal BFS.

Motor 40 may thus be energized whenever fuse 100 is in the conducting state and the lid is closed, to thereby close reed switch 52. The normal condition of fuse 100 is the conducting state, such that the motor 40 can be energized whenever lid 20 is closed unless and until there has been a brake failure signal BFS in response to which switch 110 will blow fuse 100 placing it in the non-conducting state thereby preventing subsequent energization of motor 40 until fuse 100 is reset or replaced. If the state of the lid 20 is not to be monitored for the motor cut-off, relay coil second supply terminal 92 may be coupled directly to node 74 to thus allow energization of motor 40 at all times unless there has been a brake failure as indicated by a brake failure signal BFS.

Figure 3:
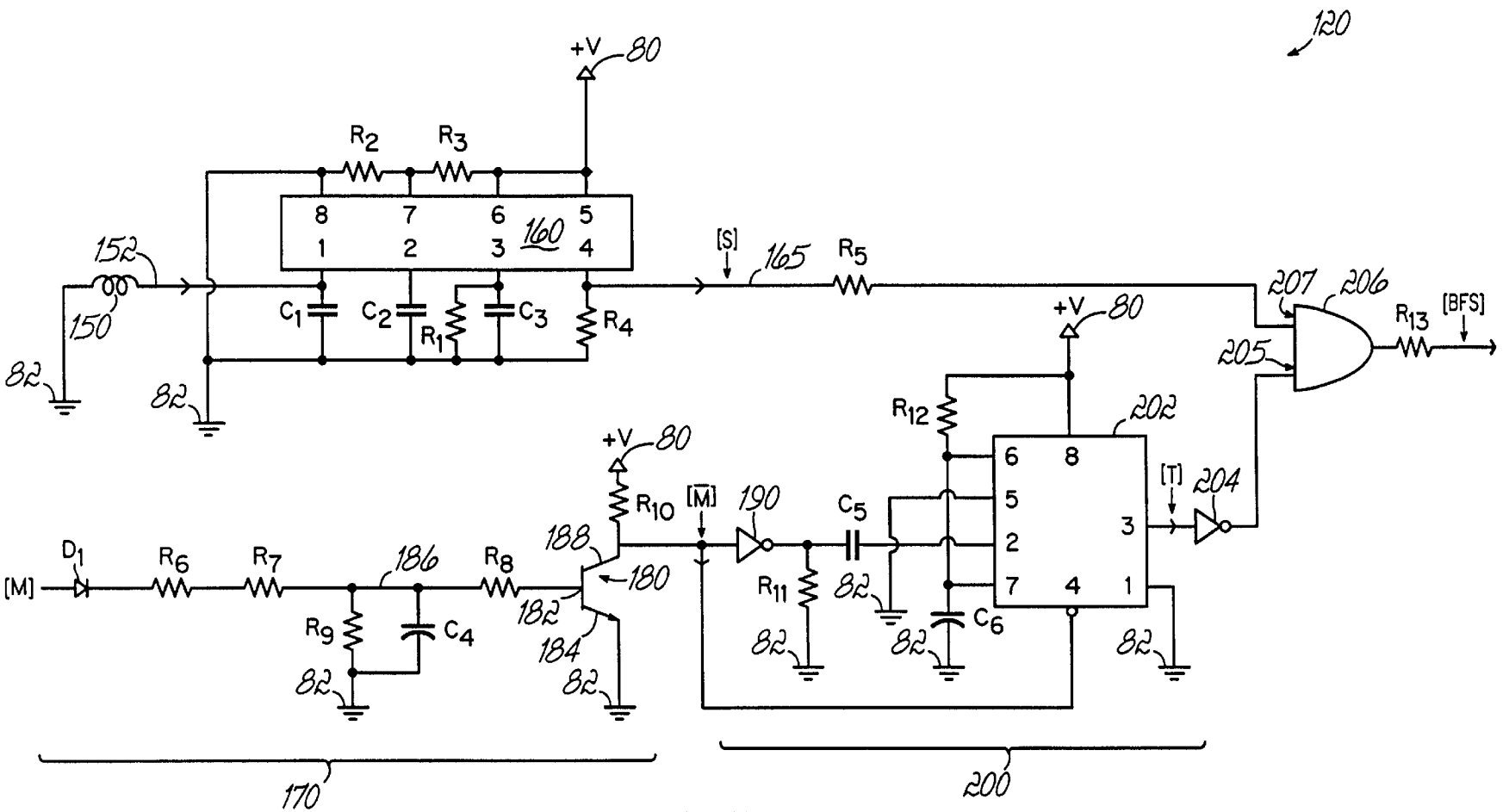
FIG. 3 is a schematic of brake failure detect circuit.

While the brake failure signal, and particularly how it is generated, form no part of the present invention, for sake of completeness, one circuit for generating a brake failure signal is shown and described in connection with FIG. 3. To that end, a speed sensor 150 associated with shaft 25 and/or basket 22 outputs a sensor signal 152 to a circuit 160 (which may be part of controls 15 or separate, as desired). Circuit 160 as shown herein is designed to output as a speed signal a spin signal S whenever the sensor signals 152 indicate that the speed of rotation of shaft 25 and/or basket 22 is above a preselected RPM, such as 20 RPM or 100 RPM. To this end, circuit 160 may be a frequency to voltage converter, such as an LM2907N-8 or equivalent set up as a speed switch. To use circuit 160, sensor signals 152 are coupled to pin 1 of circuit 160 and through 0.1 $\mu$F capacitor C1 to ground 82. Pin 2 of circuit 160 is coupled to ground 82 through 1 $\mu$F capacitor C2, with pin 3 coupled to ground 82 through the parallel combination of 1 $\mu$F capacitor C3 and 1 MΩ resistor R1. Pin 4 provides the output 165 for the spin signal (S), and is also coupled to ground 82 through 1 KΩ resistor R4. Pins 5 and 6 are directly coupled to the power supply rail 80, with pin 8 directly coupled to ground 82. Pin 7 is coupled to ground 82 through 100 KΩ resistor R2 and through 100 KΩ resistor R3 to supply rail 80. When the basket 22 is spinning above a predetermined speed, the output 165 will turn on (S) which signal is available via 1 KΩ resistor R5 for purposes to be described.

A motor spin signal [M] from controls 15 which causes motor 40 to spin may be a 120 V signal. To adjust the voltage level of signal M for use by integrated circuit electronics, a level converter circuit 170 is provided. Circuit 170 includes an input diode $D_1$ to receive signal M. The diode $D_1$ is coupled through the series combination of 10 KΩ resistors R6, R7, and 1 KΩ resistor R8 to the base 182 of NPN transistor 180, the emitter 184 of which is coupled to the ground rail 82. The junction 186 of resistors R6 and R7 is coupled to ground 82 via the parallel circuit of 2 KΩ resistor R9 and 1 μF capacitor C4. The collector 188 of transistor 180 is coupled to the supply rail 80 via 10 KΩ resistor R10 to thus provide at the output or collector 188 on inverted motor spin signal or $\overline{M}$ which is compatible with integrated logic circuits.

The inverted signal $\overline{M}$ is coupled through a digital inverter logic gate 190 to a timer circuit 200 to output a "Times Up" signal T a predetermined time after the motor spin signal M has terminated. Circuit 200 includes timer chip 202 (such as a 555 timer chip) with its trigger input (pin 2) coupled to inverter 190 through 0.01 μF capacitor C5, the input side of which is coupled to ground 82 via 100 KΩ resistor R11. The control voltage input (pin 5) of chip 202 is coupled to ground 82, and threshold and discharges reset lines (pins 6 and 7) are coupled to ground via 22 μF capacitor C6 and power supply rail 80 via 10 KΩ pull-up resistor R12. Reset line (pin 4) is coupled to the collector 188 of transistor 180 to also receive the inverted motor signal ($\overline{M}$). The output (pin 3) of chip 202 provides the time out signal T. That signal is coupled through an inverter 204 to one input 205 of AND gate 206, the other input 207 of which receives signal S from output 165 of circuit 160.

Should the motor be told to stop (i.e., signal M is discontinued), a time thereafter, signal T will be generated. If, at that time, the basket 22 is still spinning, then it may be that the brakes 34 may be failing or malfunctioning, in which event, the motor 40 should be cut-off. To that end, speed signal S will still be present causing AND gate 206 to output the brake failure signal BFS. Signal BFS may be coupled to switch 110 (such as at base 126 thereof) via 1 KΩ resistor R13 to cause switch 110 to close and blow fuse 100 (FIG. 2) such that motor 40 can no longer be energized without resetting or replacing fuse 100. If the brake 34 is working properly, speed signal S will terminate before signal T is generated, so no brake failure signal BFS will be generated, and motor 40 will continue to be energizable.

In use, washing machine 10 is operated as conventional. If the lid 20 is opened while basket 22 is spinning, the motor should be deenergized and the basket will quickly stop spinning. If, however, the brake 34 does not operate properly to quickly stop the spinning action of basket 22, fuse 100 will blow thereby preventing further operation of machine 10 until after fuse 100 is reset or replaced, such as with a service call.

By virtue of the foregoing, there is thus provided an improved brake failure safety system in the form of a fused motor cut-off.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, additional circuitry (not shown) could be included to allow for more than one incident to occur before blowing fuse 100 so as to allow for variation in behavior of the washing machine in the field before requiring a service call. By way of further example, switch 110 could be any form of state changeable switch including, not only other forms of transistor switches, but other openable and closeable switch devices such as a relay or the like as will be readily apparent to one skilled in the art. Also, switch 110 and fuse 100 could be formed as an integrated unit. Relatedly, while one possible brake failure circuit is shown, that circuit is shown by way of example only and not by way of limitation. Additionally, fuse 100 could take many forms including a fine wire that breaks open, a breaker, or a semiconductor device such as a diode, by way of example and not limitation. Any system may be used as desired by the washing machine designers to provide a brake failure signal, and the nature of the mechanics or circuitry there-involved is not a limitation on the present invention. The invention in its broader aspects is, therefore, not limited to the specific details, representative apparatus and method, and illustrative example shown and described. Accordingly, departures may be made from such details without departing from the spirit or scope of the general inventive concept.

Having described the invention, what is claimed is:

1. In a washing machine having a motor coupled to spin a basket, a brake adapted to stop the basket from spinning, and a brake failure system adapted to generate a brake failure signal indicative that the brake is failing, the motor being selectively energizable through a relay having a relay coil, the relay coil having first and second supply terminals, a motor cut-off comprising:

a fuse having a conducting state and a non-conducting state, the fuse including first and second terminals, the fuse first terminal being coupled to the coil first supply terminal and the fuse second terminal being coupled to a first supply node;

a lid switch having a first state and a second state, the lid switch coupling the coil second supply terminal to a second supply node only in the first state, the motor being energizable only when the fuse is in the conducting state and the lid switch is in the first state; and a blow switch responsive to the brake failure signal to selectively couple the fuse first terminal to a third supply node to cause the fuse to go into the non-conducting state in response to the brake failure signal to thus prevent the motor from being energizable when the lid switch is in the first state.

2. In the washing machine of claim 1, the blow switch being a transistor.

3. In the washing machine of claim 1 wherein the washing machine has a power rail and a ground rail, the first supply node being coupled to the power rail and the second supply node being coupled to the ground rail.

4. In the washing machine of claim 3, the third supply node being coupled to the ground rail.

5. In the washing machine of claim 1 wherein the washing machine has a lid with a magnet associated therewith, the lid switch being a reed switch responsive to the magnet associated with the lid whereby to place the lid switch in the first or second state depending upon whether the lid is opened or closed, respectively.

6. In the washing machine of claim 1, the fuse being resettable from the non-conducting state to the conducting state whereby to restore the ability of the motor to be energizable when the lid switch is in the first state.

7. In a washing machine having a motor coupled to spin a basket, a brake adapted to stop the basket from spinning, and a brake failure system adapted to generate a brake failure signal indicative that the brake is failing, the motor being selectively energizable through a relay having a relay coil, the relay coil having first and second supply terminals, a motor cut-off comprising:

a fuse having a conducting state and a non-conducting state, the fuse including first and second terminals, the fuse first terminal being coupled to the coil first supply terminal and the fuse second terminal being coupled to a first supply node the motor being energizable only when the fuse is in the conducting state; and a blow switch responsive to the brake failure signal to selectively couple the fuse first terminal to a second supply node to cause the fuse to go into the non-conducting state in response to the brake failure signal to thus prevent the motor from being energizable.

8. In the washing machine of claim 7, the blow switch being a transistor.

9. In the washing machine of claim 7 wherein the washing machine has a power rail and a ground rail, the first supply node being coupled to the power rail and the second supply node being coupled to the ground rail.

10. In the washing machine of claim 7, the fuse being resettable from the non-conducting state to the conducting state whereby to restore the ability of the motor to be energizable.

11. In a washing machine having a motor coupled to spin a basket, a brake adapted to stop the basket from spinning, and a brake failure system adapted to generate a brake failure signal indicative that the brake is failing, a motor cut-off comprising:

a first series circuit adapted to power the motor, the first series circuit including a fuse being coupled between power supply rails to permit energization of the motor in a conducting state of the fuse; and a second series circuit including the fuse and a blow switch, the second series circuit being coupled between power supply nodes sufficient to place the fuse in a non-conducting state in response to closure of the blow switch whereby to prevent re-energization of the motor when the fuse is in the non-conducting state, the blow switch being normally open and being closed in response to said brake failure signal, the fuse being adapted to retain the non-conducting state notwithstanding return of the blow switch to its open state.

12. In the washing machine of claim 11, the blow switch being a transistor.

13. In the washing machine of claim 11, the fuse being resettable from the non-conducting state whereby to restore the ability of the motor to be energizable.

* * * * *